US006869114B2

(12) United States Patent
Ueki

(10) Patent No.: US 6,869,114 B2
(45) Date of Patent: Mar. 22, 2005

(54) LATCH DEVICE

(75) Inventor: Yasushi Ueki, Yokohama (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 10/601,891

(22) Filed: Jun. 24, 2003

(65) Prior Publication Data

US 2004/0075281 A1 Apr. 22, 2004

(30) Foreign Application Priority Data

Oct. 17, 2002 (JP) ..... 2002-302432

(51) Int. Cl.[7] ..... E05C 17/44
(52) U.S. Cl. ..... 292/341.17; 292/DIG. 4
(58) Field of Search ..... 292/341.15, 341.17, 292/DIG. 4

(56) References Cited

U.S. PATENT DOCUMENTS 5,050,922 A * 9/1991 Falcoff ..... 296/37.7
5,217,262 A * 6/1993 Kurosaki ..... 292/6
5,292,158 A * 3/1994 Kurosaki ..... 292/45
5,401,067 A * 3/1995 Kurosaki et al. ..... 292/63
5,845,954 A * 12/1998 DePue ..... 296/37.12

FOREIGN PATENT DOCUMENTS

| | | | |
|---|---|---|---|
| DE | 42 01 006 A1 * | 7/1992 | ..... E05C/19/00 |
| JP | 0 676 521 | 10/1995 | |
| JP | 3126992 | 11/2000 | |
| JP | 2002-106238 | 4/2002 | |

* cited by examiner

*Primary Examiner*—Gary Estremsky
(74) *Attorney, Agent, or Firm*—Manabu Kanesaka

(57) ABSTRACT

A latch device engages and releases a striker by push-and-push operations. The latch device includes a case having an opening for receiving the striker therethrough, a latch member disposed inside the case and being able to be switched between an engagement position where the striker is prevented from being removed and a release position where the striker can be removed, a spring member for urging the latch member to the release position, generally heart-shaped cam grooves symmetrically provided on two sides of the latch member, and a pin member having a general U-shape and disposed inside the case. The pin member includes a U-shape intermediate portion disposed on a side opposite to the opening of the case, and edges formed at U-shape side portions. The edges project toward each other to engage and trace the cam grooves.

7 Claims, 9 Drawing Sheets

Fig. 5(a)
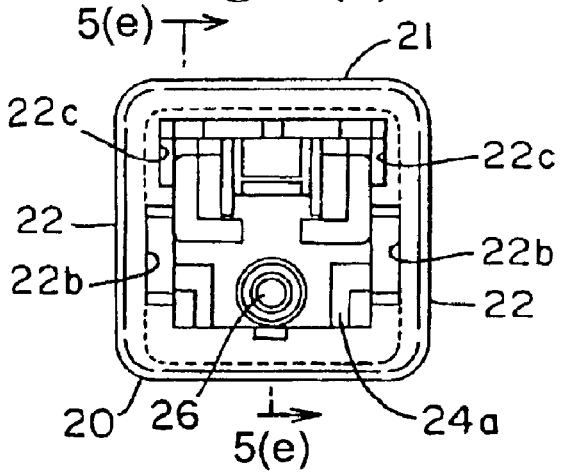
Fig. 5(b)
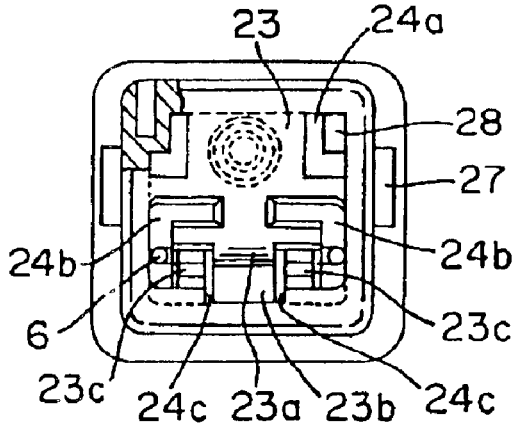
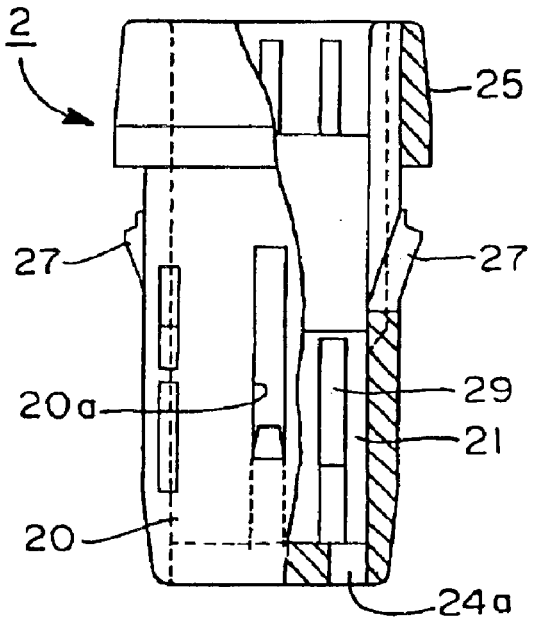
Fig. 5(c)
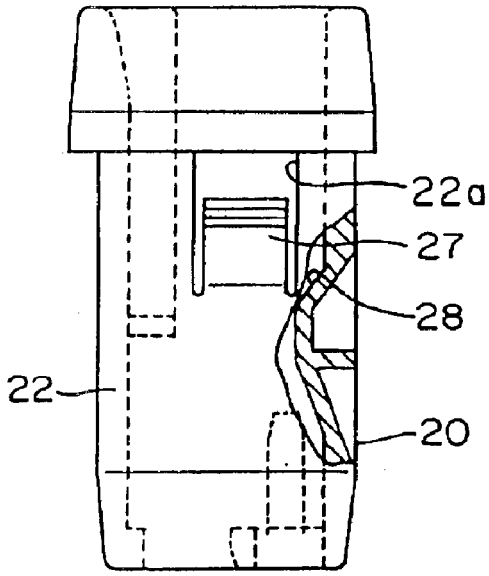
Fig. 5(d)

LATCH DEVICE

BACKGROUND OF THE INVENTION AND RELATED ART STATEMENT

The present invention relates to a latch device used, for example, when a movable member such as a lid and so on is detachably engaged with a box-like base member, and formed of a push-push engagement mechanism (this can be referred to as a push-lock and push-open mechanism), wherein a striker is engaged by the first pushing operation, and is released by the next pushing operation.

FIGS. 8(*a*)–8(*b*) and 9 are latch devices disclosed in Japanese Utility Model Publication No. 61-163870 (FIGS. 1–8) and Japanese Patent No. 3126992 (FIGS. 1–12). Each latch device 70, 80, for example, is attached to a box-like base member 60, and is formed of a push-and-push engagement mechanism which engages a striker 62 provided on a movable member 61 when the movable member 61 is moved from an open position to a closed position, and releases the engagement by a next pushing operation of the movable member 61. In these mechanisms, the latch device 70 in FIGS. 8(*a*)–8(*b*) is a fundamental embodiment of the push-and-push engagement mechanism, and formed of a case 71, a latch member 72, a spring member 75, a pin member 76 for tracing, and a leaf spring 77.

The latch member 72 includes a heart-shaped cam groove 73 and an elastic engagement portion 74, and is urged and moved in a case projecting direction with an urging force of the spring member 75 relative to the case 71. An edge of the pin member 76 projects to the cam groove 73 in a state where the base end is engaged at the bottom face inside the case. The leaf spring 77 is fixed on the case 71, and an end side presses the pin member 76 through an opening 71*a* to secure the pressure force of the pin member 76 relative to the cam groove 73.

Also, the cam groove 73, in FIG. 8(*a*), includes a guidance groove 73*a* extending to the upper left side from the bottom; a guidance groove 73*b* for engagement and a guidance groove 73*d* for release, which are located on the upper side of the guidance groove 73*a* and parting right and left; an engagement groove 73*c* located at the bottom between the guidance grooves 73*b*, 73*d*; and a return groove 73*e* extending to the bottom from the guidance groove 73*d*. The elastic engagement portion 74 includes a claw portion 74*a* on the edge.

When the latch member 72 is pushed by the striker 62, the elastic engagement portion 74 is pulled into the case 71 by elastic displacement. The claw portion 74*a* passes through the claw portion 62*a* of the striker 62, and the edge of the pin member 76 is engaged in the engagement groove 73*c*. When the latch member 72 is pushed again by the striker 62, the engagement is released by the edge of the pin member 76 entering to the return groove 73*e* from the guidance groove 73*d*.

The latch device 80 in FIG. 9 includes a case 81, a latch member 82, a spring member 85, and a pin member 86 for tracing. The latch member 82 includes heart-shaped cain grooves 83A, 83B on both bottom sides (front and back of the sheet of the drawing), and a pair of elastic engagement portions 84 on the upper side, and is urged and moved in a case projecting direction with an urging force of the spring member 85 relative to the case 81. Both cam grooves 83A, 83B have a roughly heart shape as a whole similar to the cam groove 73, but they are shaped differently. The pin member 86 is generally U-shaped, and the intermediate portion 86*a* of the U-shape is fixed on the inner bottom face of the case 81. Also, the edges 86*b* on both sides of the U-shape are bent inwardly to project into the corresponding cam grooves 83A, 83B.

The latch device 80 has a configuration such that an engagement force is increased by providing a pair of the cam grooves 83A, 83B relative to the device 70. Also, the edges 86*b* of the pin member 86 abut against groove side faces of the cam grooves 83A, 83B and trace along the different-shaped cam grooves 83A, 83B in a non-contact state with the groove bottom faces of the cam grooves 83A, 83B. The pin member 86 is moved in one direction of the cam grooves by providing a torsion force and eliminating the torsion force.

Relative to the device 70 in FIGS. 8(*a*)–8(*b*), the latch device 80 in FIG. 9 is superior in increasing the engagement force by a pair of the cam grooves 83A, 83B, and being able to control the frictional wearing of each portion or reduce the operating sound when the operation is switched because edges 86*b* of the pin member 86 are held in the non-contact state with the groove bottom faces of the cam grooves 83A, 83B.

However, it is not yet completely satisfied from the following perspective. Namely, in the device structure, the intermediate portion 86*a* is fixed onto the bottom face inside the case, and a stress received from the edges 86*b* is stored as a torsion force and eliminated, so that the operating sound can not be completely eliminated when the operation is switched, or the edges of the pin are forcibly deformed. Also, since the edges 86*b* at both sides are projected to the different-shaped cam grooves 83A, 83B, the value of the torsion force of the pin member 86 becomes easily changed due to dimensional errors of the projections of the pin edges 86*b*, etc., so that the stability of the operation is lacking.

The present invention has been made in order to solve the above mentioned problems, and the object of the invention is to provide a latch device, wherein an engagement force is increased by a pair of cam grooves to be able to keep a stable operation over a long period of time while reducing an operational sound and the load on the pin member.

Another object of the invention is to provide a latch device while improving the molding ability and appearance as compared to the conventional structure.

Further objects and advantages of the invention will be apparent from the following description of the invention.

SUMMARY OF INVENTION

In order to achieve the above-mentioned objects, the latch device of the present invention comprises a push-and-push engagement mechanism including a case into which a striker can be inserted from one end side opening; a latch member disposed inside the case and being able to be slidably switched between an engagement position where the striker is prevented from coming off and a release position where the striker can come off; a spring member for urging the latch member to move to the release position; generally heart-shaped cam grooves provided on the latch member; and a pin member tracing along the cam grooves. In the latch device, the latch member is engaged at the engagement position through the cam grooves and the pin member against a pushing force by the spring member, and the engagement is released by the next pushing operation. The cam grooves are provided on both side faces of the latch member in the same shape with the bottom faces of the grooves being substantially flat. The pin member is generally U-shaped. A U-shaped intermediate portion is supported on the other end of the case, and each edge of the U-shaped both side portions is projected into the corresponding cam groove. The pin member is substantially maintained to be able to swing at the intermediate portion.

In the latch device, when the striker pushes down the latch member in the engagement position against the urging force of the spring member, both edges of the pin member move along the corresponding cam grooves and are engaged in the engagement grooves of the cam grooves. When the striker is pushed again and this pushing force is released, this engagement state returns to the initial position after the edges of the pin member slip out of the engagement grooves and the latch member is urged and moved to the release position by the spring member.

Improvements especially reside in that both sides of the cam grooves are formed in the same shape, and that the pin member is held in the upright position to be able to swing at the other end of the case through the intermediate portion (the whole pin member swings by the predetermined load around the intermediate portion), so the torsion force of the pin edge such as the conventional device is not used in the process of switching operations. Consequently, this structure prevents the pin member from forcibly deforming with long-term usage, so that the operational defect can be prevented. Operational sounds can be reduced in several degrees as compared to the conventional devices to thereby provide high-grade sense. Also, in the molding and processing of the latch member and the pin member, both sides of the cam grooves have the same shape, or symmetrical shape, so that the accuracy of the processing can be easily ensured, and the main causes for operational defect and yield rate decline due to relative dimensional error between the members can be improved.

Preferably, the present invention is formed according to the following structures.

Namely, the case includes elastic supporting pieces, etc. for supporting the U-shaped intermediate portion of the pin member with the predetermined pressure, and vertical ribs which limit the U-shaped side portions of the pin member with respect to the corresponding inner side faces. In this structure, for example, the elastic supporting pieces allow the pin member to swing while holding in the upright position, and the vertical ribs control the movements of the U-shaped side portions of the pin member to maintain a stable positional relation between edges and cam grooves.

In the pin member, the U-shaped side portions are pressed to contact with the corresponding inner side faces of the case, and each edge of the U-shaped side portions projects in a non-contact state with the groove bottom face relative to the corresponding cam grooves. The U-shaped side portions prevent the pin member from improperly swinging due to external vibration, etc. by contact pressures of the U-shaped side portions, and also prevent the improper operations. The edges of the U-shaped side portions come to the non-contact state with the groove bottom faces of the cam grooves, so that the friction of the corresponding portions can be suppressed and the operating sound when the operation is switched can be reliably prevented.

The latch member is composed of a sliding member including the cam grooves and an opening provided on the upper side from the cam grooves and being able to slide in order to be switched between the release position and the engagement position; and a latch claw pivoted on the sliding member and projecting from the opening such that the striker is prevented from being released or removed. Also, the latch member is generally fitted inside the case in the release position. This prevents the latch member from projecting from the case in the release position as little as possible, and keeps the appearance satisfactory.

DETAILED DESCRIPTION OF PREFERRED EMBODIMENTS

Figure 1A:
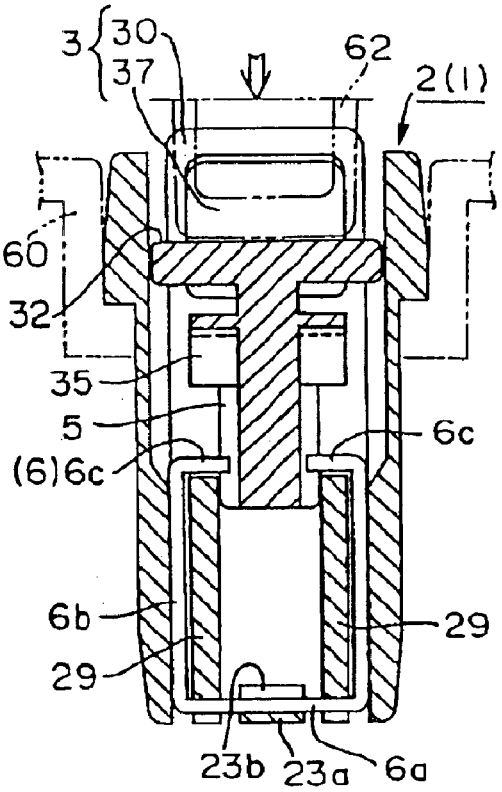
FIGS. 1(*a*)–1(*b*) are main operational views showing a latch device of an embodiment of the present invention in a release position.
Figure 1B:
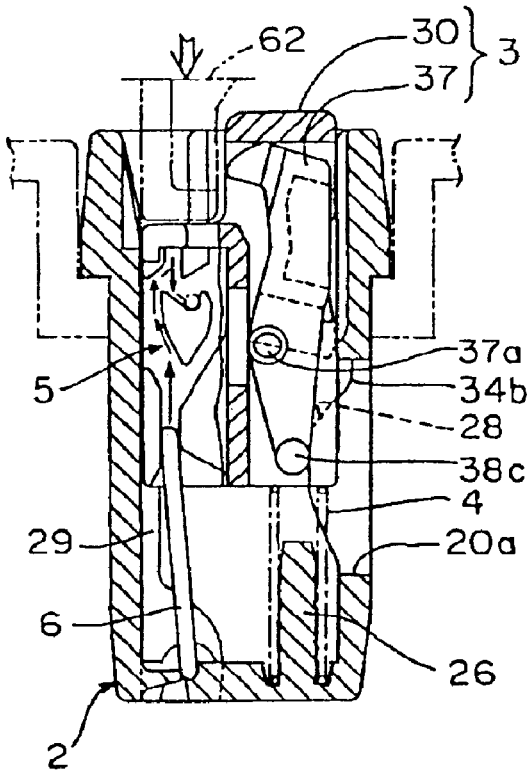
Figure 4:
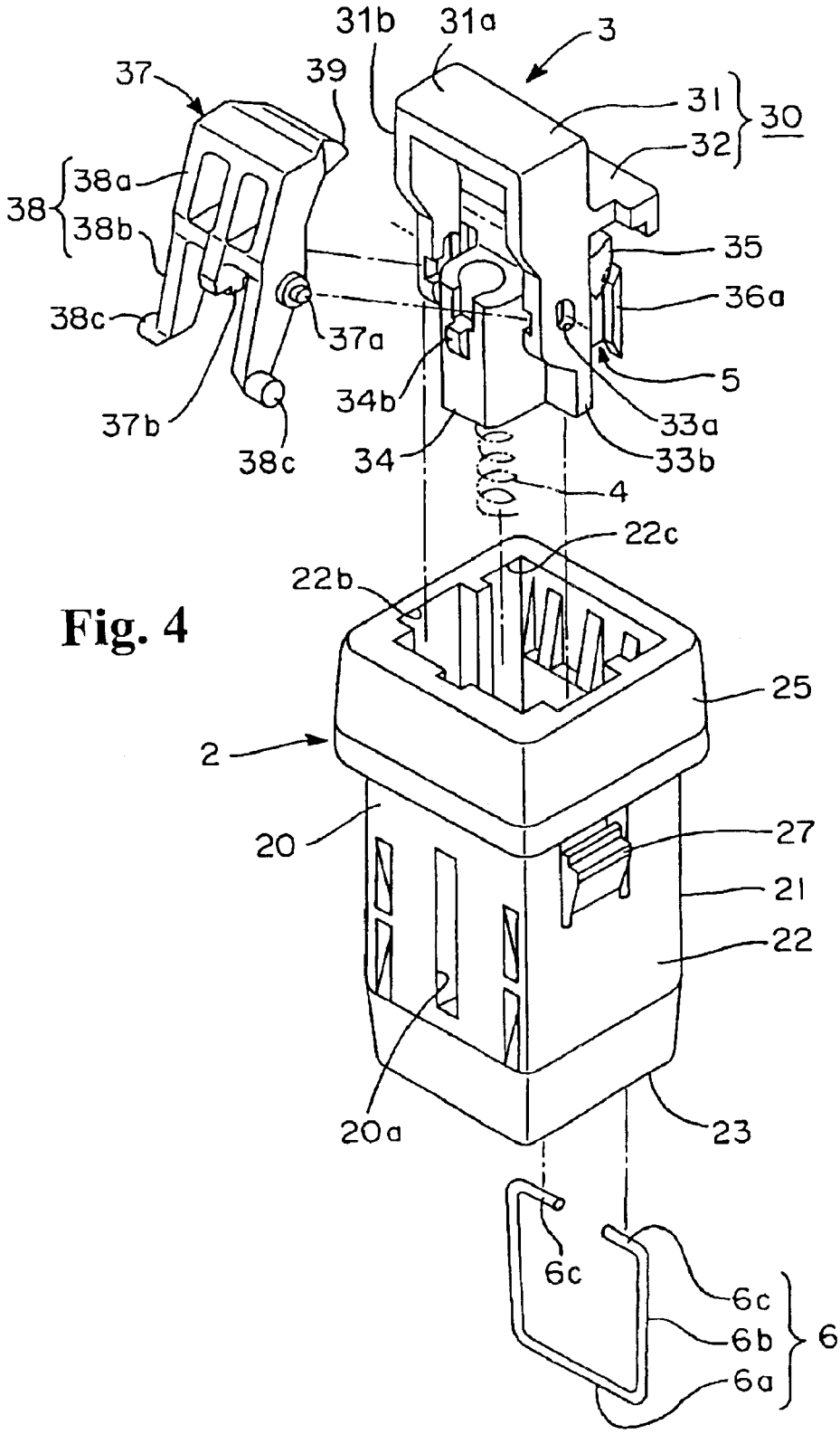
FIG. 4 is a schematic view showing the exploded latch device.

The embodiments of the present invention are explained based on the drawings. FIGS. 1(*a*)–1(*b*) through FIGS. 7(*a*)–7(*e*) show the latch device applied to the present invention. FIGS. 1(*a*)–1(*b*) and FIGS. 2(*a*)–2(*b*) show the device operation. FIGS. 1(*a*) and 2(*a*) are views sectioned generally along 1(*a*) and 2(*a*) line in FIG. 3(*a*), and FIGS. 1(*b*) and 2(*b*) are views sectioned generally along 1(*b*) and 2(*b*) line in FIG. 3(*a*). FIGS. 3(*a*)–3(*d*) show the device structure, wherein FIG. 3(*a*) is a top plan view, FIG. 3(*b*) is a front view, FIG. 3(*c*) is a view in which a case in FIG. 3(*a*) is sectioned only along line 3(*c*)—3(*c*) in FIG. 3(*a*), and FIG. 3(*d*) is a bottom view. FIG. 4 is a schematic structural view showing the exploded condition.

Figure 5E:
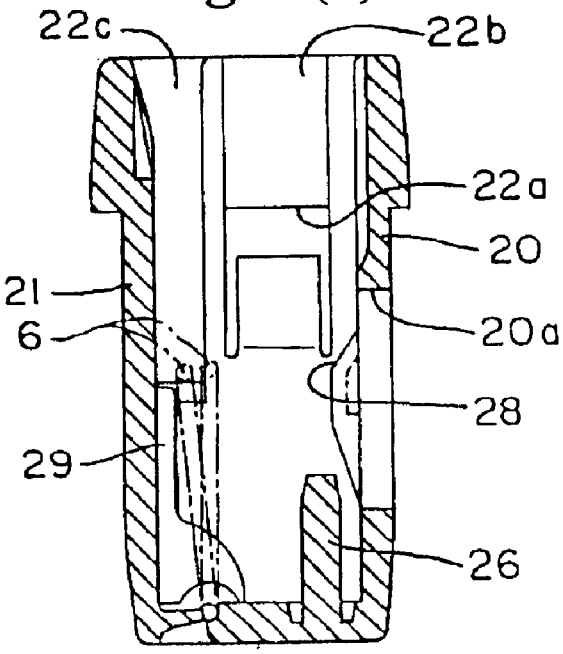
FIGS. 5(*a*)–5(*f*) are views showing a case of the latch device.
Figure 5F:
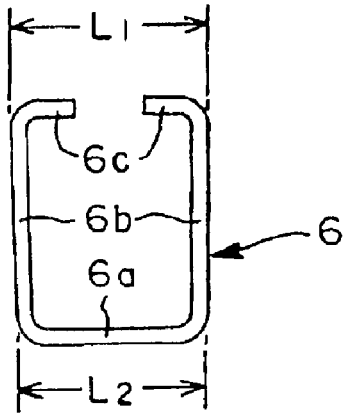
Figure 6A:
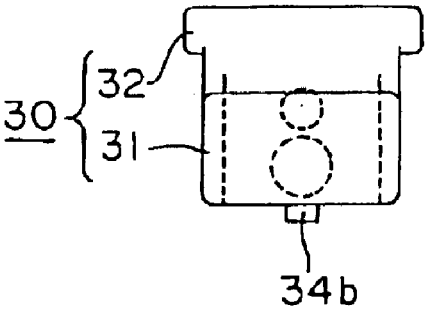
FIGS. 6(*a*)–6(*f*) are views showing a sliding member of the latch member of the latch device.
Figure 6B:
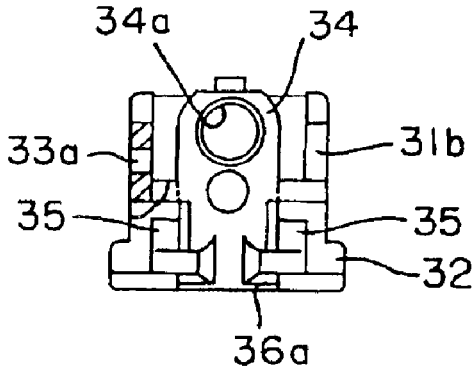
Figure 6C:
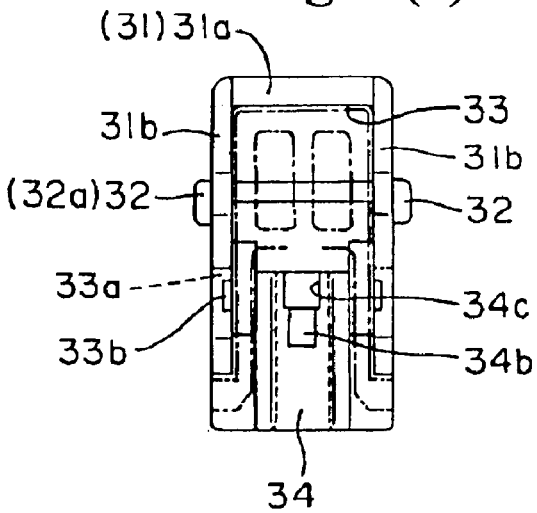
Figure 6D:
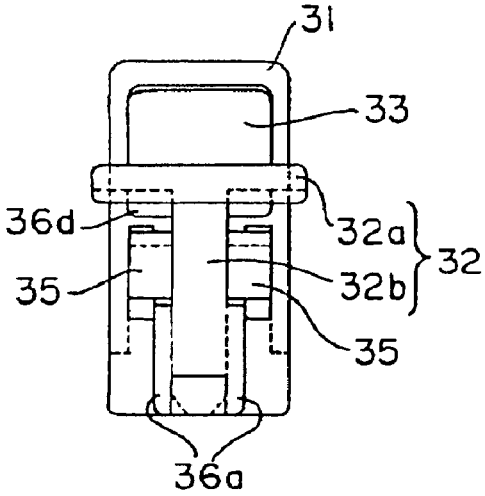
Figure 6E:
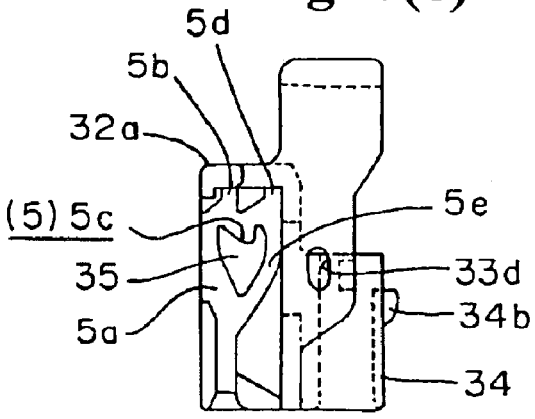
Figure 6F:
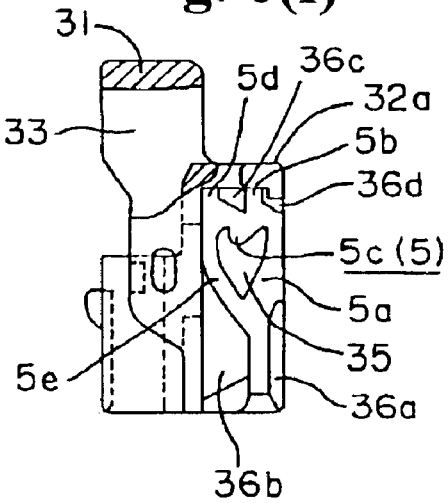
Figure 7A:
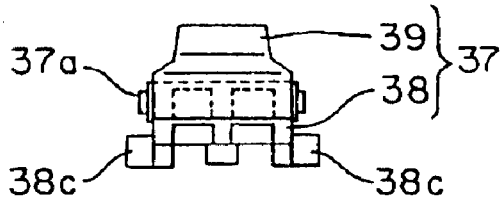
FIGS. 7(*a*)–7(*e*) are views showing a latch claw of the latch member of the latch device.
Figure 7B:
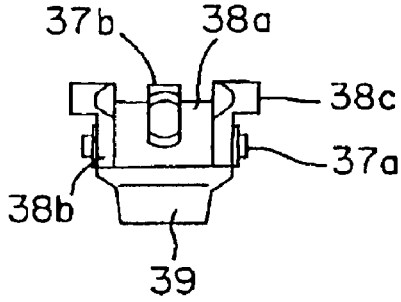
Figure 7C:
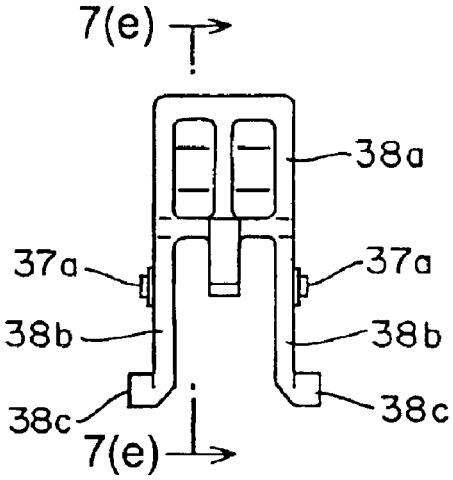
Figure 7D:
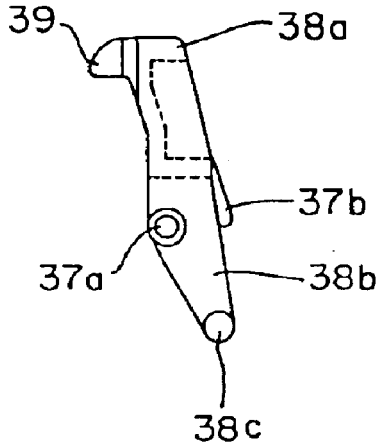
Figure 7E:
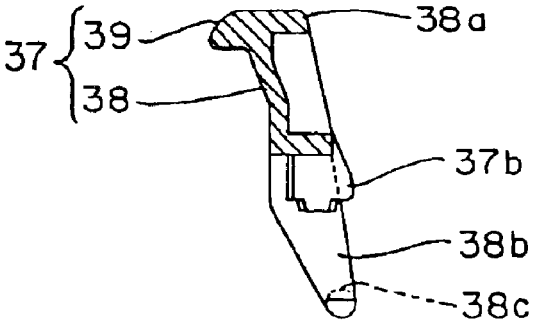

FIGS. 5(*a*)–5(*f*) show the case and the spring member, wherein FIGS. 5(*a*) and 5(*b*) are a top plan view and a bottom view of the case, FIGS. 5(*c*) and 5(*d*) are partly cut front view and side view, FIG. 5(*e*) is a cross sectional view taken along line 5(*e*)—5(*e*) in FIG. 5(*a*), and FIG. 5(*f*) is a front view of a spring member. FIGS. 6(*a*)–6(*f*) show the sliding member of the latch member, wherein FIGS. 6(*a*), 6(*b*) are partly cut top plan view and bottom view, FIGS. 6(*c*) and 6(*d*) are a front view and a rear view, and FIGS. 6(*e*) and 6(*f*) are partly cut left side view and right side view. FIGS. 7(*a*)–7(*e*) show the latch claw of the latch member, wherein FIGS. 7(*a*) and 7(*b*) are a top plan view and a bottom view, FIG. 7(*c*) is a front view, FIG. 7(*d*) is a side view, and FIG. 7(*e*) is a cross sectional view taken along line 7(*e*)—7(*e*) in FIG. 7(*c*). In the following explanation, outline, device structure, assembly, and operation of the latch device are described in order.

The latch device 1 of the embodiment is composed of a case 2; a latch members 3; and a spring member 4. Also, the latch member 3 includes a sliding member 30, and a latch claw 37. Here, the case 2, the sliding member 30, and the latch claw 37 are resin injection molding products, and the spring member 4 is made of metal or an alloy. However, other materials can be used. Also, the latch device 1 has the same intended use as the above-mentioned prior art devices, and is used when a movable member such as a lid, etc. is detachably engaged with a box-like base member. Usually, the latch device 1 is attached to the box-like base member, and the striker 62 provided on the movable member is engaged and disengaged. However, it can be used by attaching the latch device 1 to the movable member and engaging with and disengaging from the striker 62 provided on the box-like base member, as shown in Japanese Patent No. 3314903.

The latch device 1 of the embodiment is the push-and-push engagement mechanism which works, for example, in the condition that the movable member is urged in the close position, such that the movable member is engaged through the striker 62 when the movable member is pushed into the close position against the urging force, and then, the engagement of the movable member is released when the movable member is pushed in the same direction and the hand is released. At this time, especially, the latch member 3 or the sliding member 30 slide linearly by the striker 62. The components are as follows.

In the case 2, the inside is formed and divided by front and back walls 20, 21; both side walls 22; and a bottom wall 23, as shown in FIGS. 4 and 5(*a*)–5(*f*). The case 2 has a hollow shape whose end side or upper side is open. Also, an upper exterior surface 25 projects outwardly to be installed in a depressed part provided on the attachment portion such as the box-like base member, etc., as shown in FIGS. 1(*a*)–1(*b*) . Here, the front wall 20 includes a guide groove 20*a* located in the intermediate part between the right and left, and controlling a sliding range of the latch member 3 (sliding member 30); and an enlarged portions 28 projecting at both inner faces and allowing the latch member 3 (latch claw 39) to rotate to an engagement position. On the inner face of the back wall 21, a pair of vertical ribs 29 for control projects corresponding to the U-shape pin member 6. The vertical ribs 29 are extended to nearly the intermediate position between the top and bottom from the bottom wall 23, and provided in a state where the lower side is enlarged. As shown in FIG. 1(*a*), both U-shaped side portions 6*b* of the pin member 6 are positioned and held between the corresponding inner side faces of the side walls 22.

On both side walls 22, elastic engagement claws 27 for attachment which are divided through U-shaped slits 22*a* and whose upper sides are extended to the outside are provided. On the inner faces of both side walls 22, escape depressions 22*b* and guide depressed portions 22*c*, which are extended in an up-and-down direction, are provided to face each other respectively. The escape depressions 22*b* are removing portions for a molding tool forming the elastic engagement claw 27 and enlarged portions 28, and the enlarged portions 28 project beneath the escape depressions 22*b*. The guide depressed portions 22*c* are fit into a projected portion 32 of the sliding member 30 in order to be freely slidable.

The bottom wall 23 includes die-cutting bores 24*a* passing through both front sides; roughly L-shaped pin-pass-through bores 24*b* passing through the back of both sides; elastic supporting pieces 23*a*, 23*b* divided and formed through small slits 24*c* between both pin-pass-through bores 24*b*; pin-catching portions 23*c* formed between each pin-pass-through bore 24*b* and each small slit 24*c*; and a supporting axis 26 for a spring projecting to the front inner face. Each pin-pass-through bore 24*b* has a bore width slightly larger than the diameter of the wire of the pin member 6, and allows the roughly U-shaped pin member 6 to be inserted into the case from the bore.

The elastic supporting pieces 23*a*, 23*b* are placed opposite to each other through a small gap. One side 23*a* is formed short and another side 23*b* is formed long. The U-shaped intermediate portion 6*a* of the pin member 6 can be held with a predetermined supporting force as shown in FIG. 1(*a*). The pin-catching portions 23*c* are places where both sides of the U-shaped intermediate portion 6*a* supported between the elastic supporting pieces 23*a*, 23*b* are caught. The supporting axis 26 projects in the middle between the right and left, whose edge has a height visible through the guide groove 20*a*.

In the elastic supporting pieces 23*a*, 23*b*, the pin member 6 is supported, and the spring member 4 is held on the supporting axis 26. The spring member 4 is a coil spring, the lower side is attached to the supporting axis 26, and the upper side is placed on the corresponding part of the latch member 3 (sliding member 30). The pin member 6, as shown in FIG. 5(*f*) is formed of a U-shaped intermediate portion 6*a*; U-shaped side portions 6*b*; and edges 6*c* whose free ends of both side portions 6*b* are bent inside. Also, a U-shaped upper width L1 is formed slightly larger than the lower width L2. The lower width L2, when held inside the case, almost corresponds to the width between the inner faces of both side walls 22.

The latch member 3 is required to be slidably placed inside the case; to receive the striker 62 to engage therewith when the latch member 3 is pushed into the case; and to include heart-shaped cam grooves 5 where the pin member 6 traces. In this embodiment, the latch member 3 is composed of a sliding member 30 and a latch claw 37. In these members, the sliding member 30 includes a projecting portion 32 on the rear face side of a main member 31 as shown in FIGS. 4 and 6(*a*)–6(*f*).

The main member 31 is formed in a roughly U shape frame with an upper portion 31*a* and both side portions 31*b*. On the upper side, an opening 33 surrounded by the upper portion 31*a* and both side portions 31*b* is provided. On the lower side, axis bores 33*a* passing through the same axis line relative to the side portions 31*b* and depressed portions 33*b* are additionally provided. Also, a tube or hollow portion 34 is additionally provided between the side portions 31*b*. The tube portion 34 has a bore wherein in an inner side 34*a*, the supporting axis 26 and the upper side of the spring member 4 can slidably engage. Also, the tube portion 34 includes a projection 34*b* fitted into the guide groove 20*a*, and a notch 34*c* cut in the upper side of the projection 34*b*.

The projecting portion 32 includes a horizontal wall portion 32*a* against which the striker 62 abuts, and a vertical wall portion 32*b* extending downward from the middle between the right and left of the horizontal wall portion 32*a*. The horizontal wall portion 32*a* has sides slightly projecting to the outside from the main member 31, and is slid in a state fitted into the guide depressed portions 22*c* of the case 2. The vertical wall portion 32*b* includes heart-shaped cam grooves 5 on both sides.

Both sides of the cam grooves 5, as shown in FIGS. 6(*d*)–6(*f*), have the same height and shape, and are formed and divided by convex cam islands 35 projecting in the roughly central part of the vertical wall portion 32*b*. Each cam groove 5 includes a blade piece 36*a* extending over a lower side of the vertical wall portion 32*b*; a thick-walled portion 36*b* provided on the vertical wall portion 32*b* and forming the entrance side of the cam groove 5 together with the blade piece 36*a*; and two small projections 36*c*, 36*d* provided under the horizontal wall portion 32*a*. In operation, in FIGS. 6(*e*) and 6(*f*), each cam groove includes an introducing groove 5*a* extending to the upper right side from the lower side; an introducing groove 5*b* for engagement and an introducing groove 5*d* for release, which are located on the upper side of the introducing groove 5*a* and parted right and left; a depressed engagement groove 5*c* located on the lower side between the introducing grooves 5*b,* 5*d;* and a return groove 5*e* extending to the lower side from the introducing groove 5*d.* Also, the bottom face of each groove 5*a*–5*e* has a roughly flat surface.

On the other hand, the latch claw 37, as shown in FIGS. 4 and 7(*a*)–7(*e*), is formed of a supporting plate 38 and a claw portion 39, and the whole part is located between the upper portion 31*a* and both side portions 31*b* of the main member 31 in a state where the claw portion 39 is located inside the opening 33. In the supporting plate 38, at the upper portion 38*a,* the claw portion 39 projects, and at the lower portion 38*b,* there is no intermediate part. When the upper portion 38*a* is disposed inside the U-shaped frame of the main member 31, the claw portion 39 enters the opening 33. The lower portion 38*b* has two pieces extending from the upper portion 38*a,* and includes axis portions 37*a* provided on the external surfaces of the lower portions 38*b* in the middle thereof; and projecting portions 38*c* provided on the lower ends. A projecting piece 37*b* entering into the tube portion 34 is provided between both lower portions 38*b.*

Figure 2A:
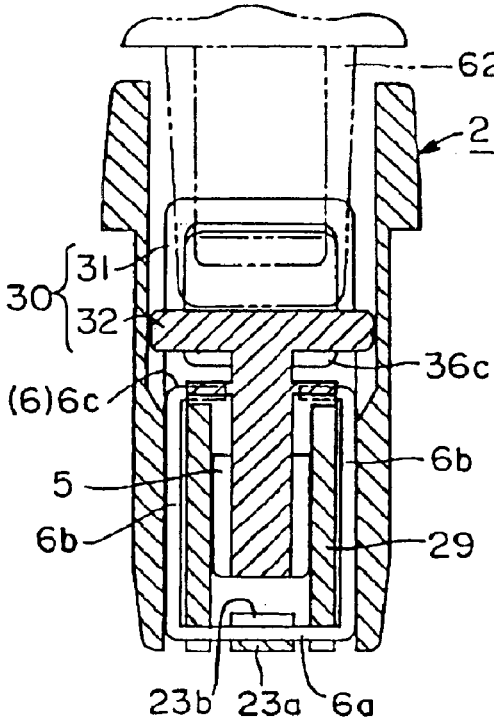
FIGS. 2(*a*)–2(*b*) are main operational views showing the latch device in an engagement position.
Figure 2B:
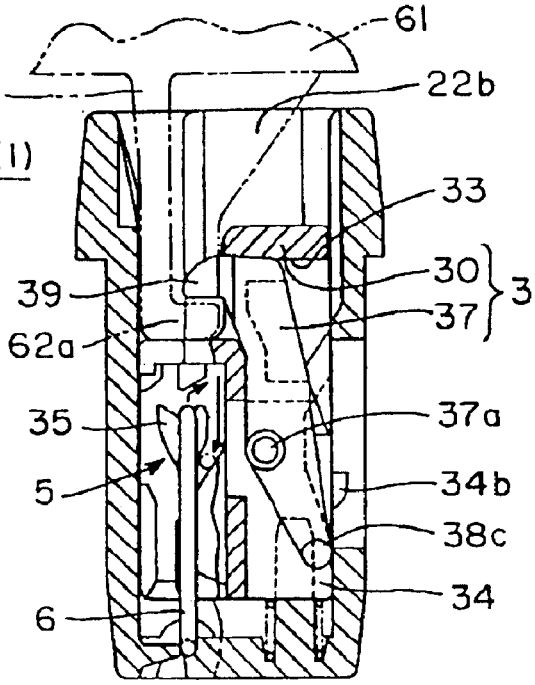
Figure 3A:
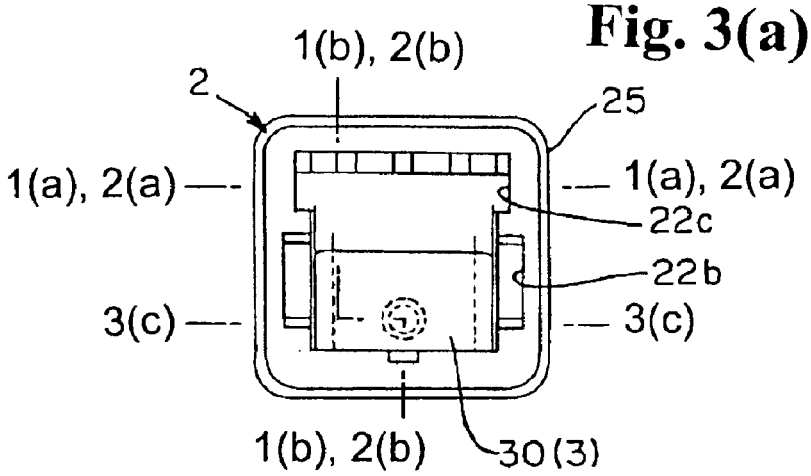
FIGS. 3(*a*)–3(*d*) are views showing respective portions of the latch device.
Figure 3B:
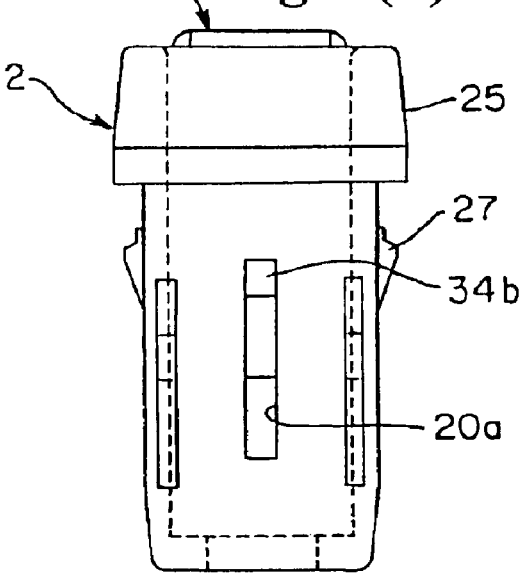
Figure 3C:
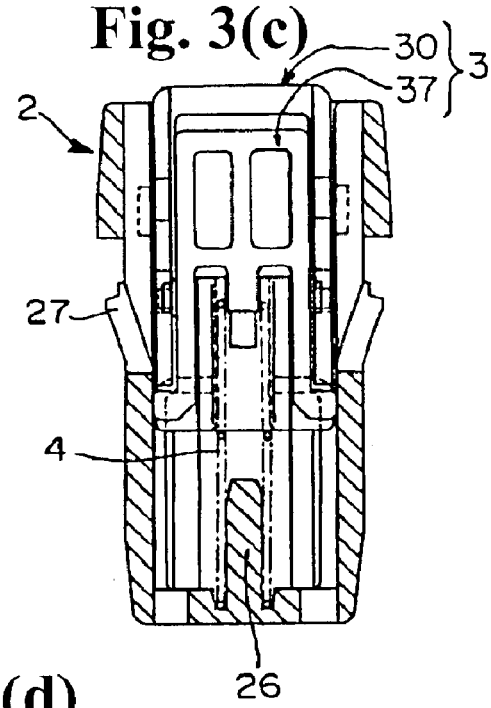
Figure 3D:
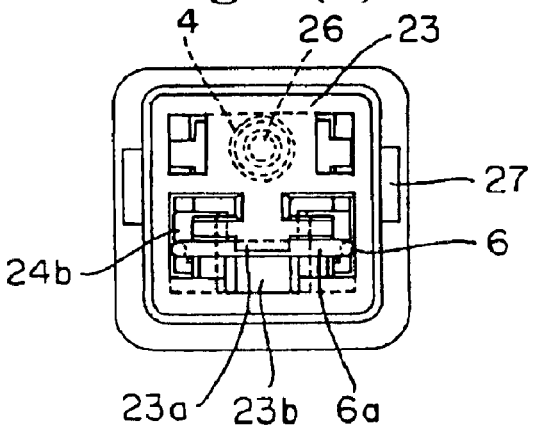

Each member of the present invention is assembled in the following manner. First, the sliding member 30 is attached to the latch claw 37. In this operation, from the state of FIG. 4, the axis portions 37*a* are pushed into the axis bores 33*a* from the depressed portions 33*b*. Thereupon, the latch claw 37 is supported around the axis portions 37*a* in order to be rotatable only for the predetermined range, and can be rotated to switch between the release state where the claw portion 39 falls into the opening 33 as shown in FIG. 1(*b*); and the engagement state where the claw portion 39 is projected from the opening 33 and presses the projecting portion or the claw portion 62*a* of the striker 62 from above as shown in FIG. 2(*b*). Also, the projecting piece 37*b* of the claw portion 39 enters the tube portion 34 of the sliding member 30, and a part of the projecting piece 37*b* escapes from the notch portion 34*c* when it is switched to the engagement state.

Next, the sliding member 30 including the latch claw 37 or the latch member 3 is attached into the case 2. In this operation, optimally, the spring member 4 should be beforehand attached to the supporting axis 26, and the pin member 6 is slidably held on the bottom wall 23 inside the case 2. In the pin member 6, both sides of the edges 6*c* are inserted into the case from the pin pass-through bores 24*b*, and then the U-shaped intermediate portion 6*a* is forcibly moved to the elastic supporting pieces 23*a*, 23*b* sides, so that the pin member 6 is supported between the inner side elastic supporting piece 23*b* and the outer side elastic supporting piece 23*a* in a state caught by the pin-catching portions 23*c* at both sides. In this supported state, the pin member 6 is stood up and held in the case 2, and the upper sides of both side portions 6*b* are slidably pressed and contacted with both inner faces at the U-shaped upper width L1. Also, both U-shaped side portions 6*b* are held in the positions between the vertical ribs 29 and the corresponding inner side faces.

Once the latch member 3 is pushed into the case 2 in a state where both sides of the horizontal wall portion 32*a* are aligned with the corresponding guide depressed portions 22*c*, the projection 34*b* is passed through and attached to the case 2 when the projection 34*b* falls into the guide groove 20*a* and is fitted. In addition, in the process where the latch member 3 is pushed in, the upper side of the spring member 4 enters the tube portion 34, and abuts against the projecting piece 37*b* of the latch claw 37. Also, both edges 6*c* of the pin member 6 enter the corresponding entrances of the cam grooves 5 (grooves extending downward from the return grooves 5*e*).

When the assembled latch device 1 is looked from the upper side, the latch device 1 is in a state where the claw portion 39 of the latch claw 37 is invisible, or a release state. As a use condition, for example, corresponding to the striker 62 of the movable member 61, the latch device 1 is attached to an adequate position of the box-like base member 60 through the elastic engagement claws 27. In the attached state of the latch device 1, as shown in FIGS. 1(*a*)–1(*b*), the latch member 3 is urged and moved by the spring member 4 (this movement is restricted by the projection 34*b* hitting the upper end face of the guide groove 20*a*), and also, the claw portion 39 is rotated in a direction to enter the opening 33 (this rotation is performed by the projecting portions 38*c* mounted on the highest place of the enlarged portion 28). This state is a "release position of the latch member 3", and the latch member 3 is roughly fitted in the case 2.

When the latch member 3 is pushed in the arrow direction of FIGS. 1(*a*)–1(*b*) against the urging force of the spring member 4 by the striker 62, the latch claw 37 is rotated around the axis portions 37*a*, and stops the claw portion 62*a* of the striker 62. Also, the latch member 62 is engaged in the engagement position of FIGS. 2(*a*)–2(*b*) by releasing the pushing force. In other words, each edge 6*c* of the pin member 6 enters each introducing groove 5*b* for engagement from the introducing groove 5*a* by the downward movement of the latch member 3, and when the pushing force against the latch member 3 is released, each edge 6*c* of the pin member 6 is engaged in the engagement groove 5*c*. By this engagement, the movable member 61 is maintained in the close position.

When the latch member 3 is switched from FIGS. 2(*a*)–2(*b*) to FIGS. 1(*a*)–1(*b*), the latch member 3 is pushed again through the striker 62, and the pushing force is released (to release the pushing hand). Then, each edge 6*c* goes through the introducing groove 5*d* for release and the return groove 5*e* from the engagement groove 5*c*, and again returns to the entrance groove from the introducing groove 5*a*. At the same time, the latch member 3 (the sliding member 30 and the latch claw 37) is switched to the original release position. In addition, when the claw portion 62*a* of the striker 62 is released from the latch claw 37, the movable member 61 is automatically switched and returned to the open position by urging mean not shown in the figure.

In the switching process in operation, the pin member 6 swings around the U-shaped intermediate portion 6*a* by the force received from the groove side walls of the cam grooves 5 in the non-contact state with the groove bottom face, and at the same time, each edge 6*c* is traced or moved in arrow directions shown in the cam groove 5 in FIG. 1(*b*) or FIG. 2(*b*). In this case, since the pin member 6 is traced while swinging around the U-shaped intermediate portion 6*a*, the torsion force is not formed as in the conventional spring member 6, and the pin member 6 is moved against the supporting force by the elastic supporting pieces 23*a*, 23*b* and the contacting pressures at the side portions 6*b*.

As a result, in this structure, the pin member 6 is not easily partially deformed like a conventional structure, and also the tracing operation of each edge 6*c* for each cam groove 5 can be carried out stably and finely. In addition, an operating sound that is easily produced when the operation is switched can be prevented more reliably.

Figure 8A:
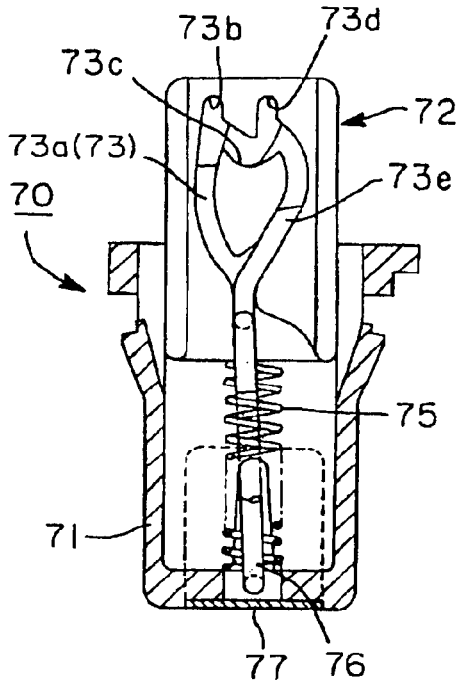
Fig. 8(a) Prior Art
FIGS. 8(*a*)–8(*b*) are views showing an embodiment of the conventional latch device.
Figure 8B:
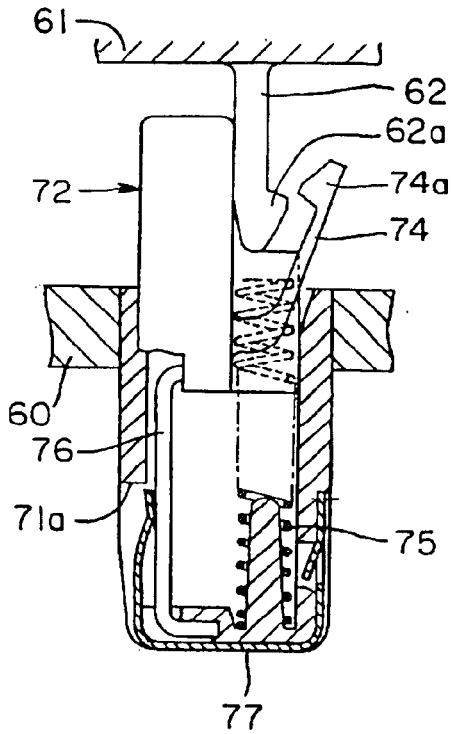
Fig. 8(b) Prior Art

Also, the present invention is not limited to the above-mentioned embodiment. For example, as the latch member 3, the structure integrating the sliding member 30 and the latch claw 37 can be used. In this case, the latch claw is integrated into the sliding member as a single elastic engagement portion as the embodiment shown in FIGS. 8(*a*)–8(*b*), or a pair of elastic engagement portions as shown in FIG. 9.

Figure 9:
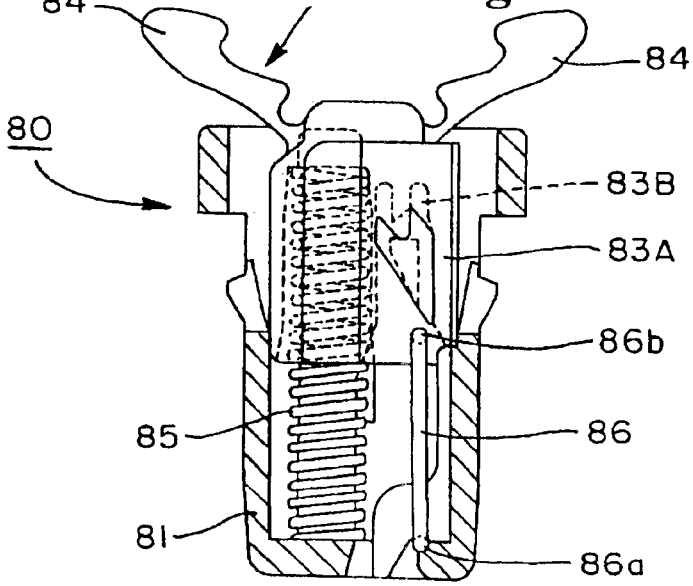
Fig. 9 Prior Art
FIG. 9 is a view showing an embodiment of other conventional latch device.

As explained above, the latch device of the present invention can prevent the pin member from being forcibly deformed to cause the operating defect, as compared to the structure of FIG. 9. Also, this latch device can make the operating sound far smaller than the conventional device, improve the quality, and provide high grade device. Also, in regard to the components, the accuracy of dimension between the components can be easily maintained, etc.

While the invention has been explained with reference to the specific embodiments of the invention, the explanation is illustrative and the invention is limited only by the appended claims.

What is claimed is:

1. A latch device for engaging and releasing a striker by push-and-push operations, comprising:

a case having an upper opening for receiving the striker therein, a latch member disposed inside the case and being able to be switched between an engagement position where the striker is prevented from being removed and a release position where the striker can be removed, a spring member disposed in the case for urging the latch member to move to the release position, two sets of generally heart-shaped cam grooves having the same size and same shapes each having generally flat bottom faces, said two sets of cam grooves being provided on two sides of the latch member symmetrically relative to a center plane between the two sides of the latch member, and a pin member having a general U-shape and including a U-shape intermediate portion disposed on a side opposite to the opening of the case, and U-shape side portions with edges projecting toward each other to engage and trace the two sets of the cam grooves in a same manner simultaneously, said pin member being disposed inside the case to be able to swing at the intermediate portion.

2. A latch device according to claim 1, wherein said case includes an elastic supporting piece for supporting the U-shape intermediate portion of the pin member with a predetermined pressure, and vertical ribs for limiting the U-shape side portions of the pin member in positions together with corresponding inner side faces of the case.

3. A latch device according to claim 1, wherein said pin member has a width such that the U-shaped side portions are pressed with corresponding inner side faces of the case, and each edge of the U-shape side portions projects inwardly without contacting the groove bottom face of the cam grooves.

4. A latch device according to claim 1, wherein said latch member includes a sliding member having said cam grooves and a side opening provided on an upper side from the cam grooves and being able to slide to switch between said release position and said engagement position; and a latch claw pivotally attached to the sliding member, said latch claw projecting from the side opening to engage the striker at the engagement position and generally entering inside the sliding member in the release position.

5. A latch device according to claim 4, wherein said latch claw has a claw portion at one side, a shaft portion pivotally attached to the sliding member and a projecting portion at a side opposite to the claw portion relative to the shaft portion, and said case has an enlarged portion at one side thereof, said projecting portion sliding along the enlarged portion by a sliding movement of the latch member to allow the claw portion to move in and out from the sliding member.

6. A latch device according to claim 1, wherein said latch member is held at the engagement position by engagements of the cam grooves with the edges of the pin member by a pushing operation against the spring member, said engagements being released by a next pushing operation.

7. A latch device for engaging and releasing a striker by push-and-push operations, comprising:

a case having an upper opening for receiving the striker therein, a latch member disposed inside the case and being able to be switched between an engagement position where the striker is prevented from being removed and a release position where the striker can be removed, said latch member including a sliding member having a side opening and being able to slide inside the case to switch between said release position and said engagement position, and a latch claw pivotally situated inside the sliding member, said latch claw projecting from the side opening inside the case to engage the striker at the engagement position and being generally located inside the sliding member in the release position, a spring member disposed in the case for urging the latch member to move to the release position, generally heart-shaped cam grooves symmetrically provided on two sides of the latch member and having generally flat bottom faces, and a pin member having a general U-shape and including a U-shape intermediate portion disposed on a side opposite to the opening of the case, and U-shape side portions with edges projecting toward each other to engage and trace the cam grooves, said pin member being disposed inside the case to be able to swing at the intermediate portion.

* * * * *